US006386960B1

(12) United States Patent
Wei

(10) Patent No.: US 6,386,960 B1
(45) **Date of Patent: *May 14, 2002**

(54) CHEMICAL-MECHANICAL POLISHING METHOD AND APPARATUS

(75) Inventor: Zin-Chein Wei, Hsin-Chu (TW)

(73) Assignee: Taiwan Semiconductor Manufacturing Company, Hsin-Chu (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 553 days.

(21) Appl. No.: 08/730,385

(22) Filed: Oct. 16, 1996

(51) Int. Cl.[7] ..... B24B 7/22
(52) U.S. Cl. ..... 451/288; 451/41
(58) Field of Search ..... 451/287, 288, 451/289, 290, 291, 41

(56) References Cited

U.S. PATENT DOCUMENTS 2,423,118 A * 7/1947 Ramsay ..... 451/41
2,539,561 A * 1/1951 Wolfskill ..... 451/288
3,615,955 A 10/1971 Regh ..... 156/17
5,492,594 A 2/1996 Burke et al. ..... 216/86
5,582,534 A * 12/1996 Shendon et al. ..... 451/41
5,899,800 A * 5/1999 Shendon ..... 451/291

* cited by examiner

*Primary Examiner*—Robert A. Rose
(74) *Attorney, Agent, or Firm*—George O. Saile; Stephen B. Ackerman

(57) ABSTRACT

A polishing system is described in which the substrate that is to be polished (generally a silicon wafer) is given three independent, simultaneously applied, modes of motion. These are: rotation of the platen, rotation of the wafer, and orbital motion of the wafer. A machine for realizing this is detailed It includes a crank that is used to cause the wafer to revolve in a closed path on the surface of the polishing pad at the same time that it moves around the circumference of the pad. A method for using this machine to perform CMP is also given. Use of the method and apparatus of this invention leads to a more uniform distribution of slurry during chemical-mechanical polishing.

2 Claims, 2 Drawing Sheets

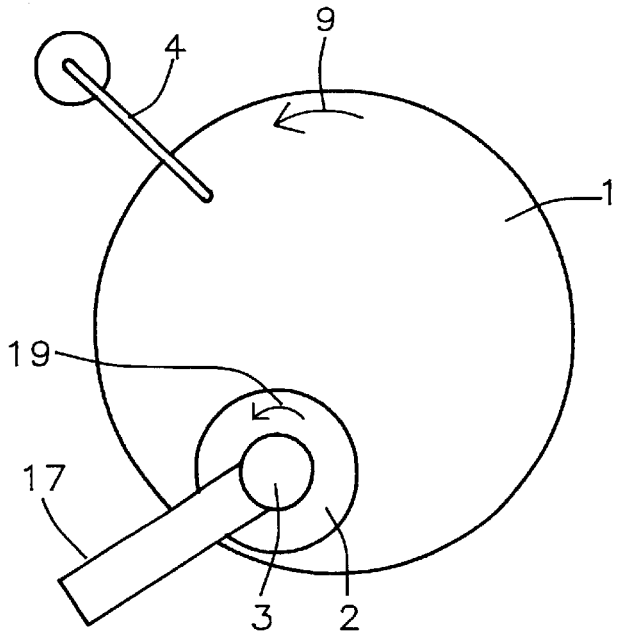
FIG. 1 – Prior Art
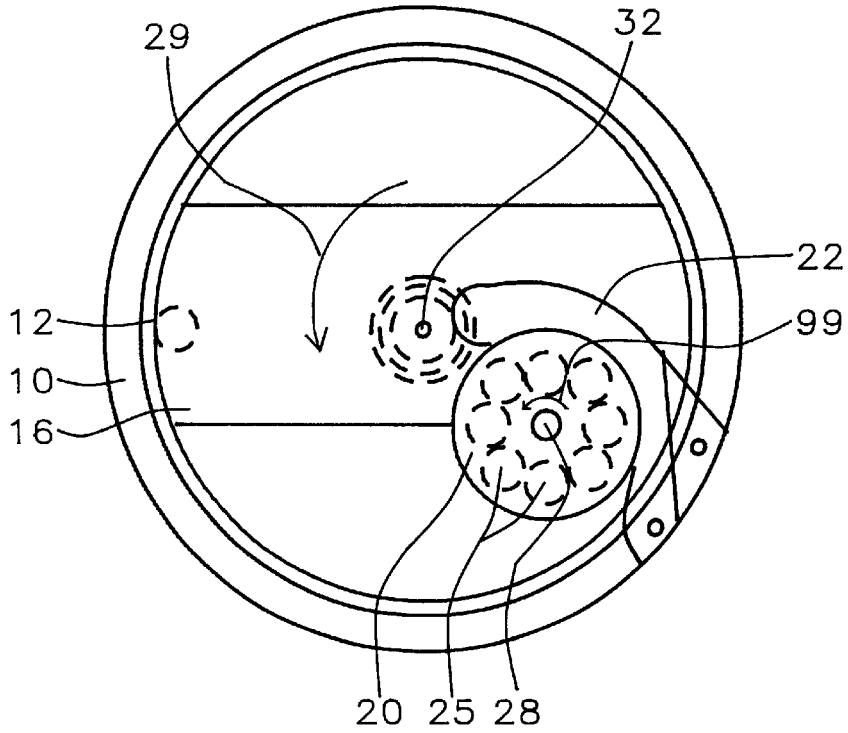
FIG. 2 – Prior Art

CHEMICAL-MECHANICAL POLISHING METHOD AND APPARATUS

BACKGROUND OF THE INVENTION (1) Field of the Invention

The invention relates to the field of Chemical-Mechanical Polishing more particularly to ways to improve uniformity of material removal.

(2) Description of the Prior Art

In integrated circuit technology, the removal of various layers is usually accomplished through use of liquid or gaseous etchants. In these cases, the reaction products are fluids that are readily removed from the reaction site so that etching can proceed at a uniform rate. In certain cases, however, the reaction products are insoluble solids that are, at best, hard to remove. At worst, such etchants serve only to undermine, or weaken, the layer's integrity near the surface and, in the absence of any other action, are thus quite ineffective as etchants.

In etching situations of this sort, mechanical assistance in the form of a slurry comprising an abrasive powder suspended in a suitable liquid medium (such as the etchant itself) can be used to complement the action of the chemical etchant. This technique for removing material through a combination of chemical and mechanical means is referred to as Chemical Mechanical Polishing (CMP).

While CMP makes possible the controlled removal of materials that could not be effectively removed in any other way, it tends to be slow unless relatively large amounts of slurry are used. There is thus relatively little time for slurry to be evenly distributed before it, together with any process byproducts, has to be removed and replaced with fresh slurry. It follows that for CMP to achieve uniform material removal rates over large areas, slurry must be evenly distributed as quickly as possible, once it has been dispensed onto the polishing surface.

In the prior art, rapid distribution of slurry has been achieved by simultaneously rotating both the platen (on which the slurry bearing pad sits) and the substrate (usually a silicon wafer) that is to be polished. An example of this is shown in FIG. 1 which has been taken from a patent by Burke et al. (U.S. Pat. No. 5,492,504 February, 1996). Wafer holder 2 keeps a silicon wafer (not seen) pressed up against pad 1. Said pad is supported by a platen (not seen) that is directly beneath it. Means for rotating the platen (not shown) cause it to move in the direction symbolised by arrow 9.

Still referring to FIG. 1, rotation causing means 3 (such as an in-situ motor), held in position by support arm 17, causes wafer holder 2 to rotate in the direction symbolised by arrow 19 while at the same time keeping the wafer to be polished pressed against pad 1. Slurry is dispensed onto pad 1 from slurry dispenser 4 while both pad and wafer are rotating. Slurry is thus swept along the outside edge of pad 1 to an outside edge of the wafer at which point the rotation of the wafer further distributes the slurry across the wafer.

A slightly different approach for achieving uniform slurry distribution is illustrated in FIG. 2 which has been taken from a patent by Regh et al. (U.S. Pat. No. 3,615,955 October, 1971). Pad 16, on platen 10, rotates as indicated by arrow 29. Wafer holder 20, holding multiple wafers, such as 25, is caused to rotate about center of rotation 28 in direction 99. Arm 22 serves to stabilize 20 while it rotates. Slurry is dispensed through opening 32 in a slurry supply bottle (not shown) that is suspended above the pad. Used slurry is removed at drain 12.

It is important to note that in the Regh system shown in FIG. 2 each wafer 25 rotates only once for each orbit about center of rotation 28. It has been our observation that a better distribution of slurry (resulting in a more uniform removal rate across the surface of a wafer) can be achieved if the wafer(s) are able to rotate more than once per orbit.

SUMMARY OF THE INVENTION

It is an object of the present invention to provide a CMP process and apparatus that distributes slurry more evenly than does the prior art, without the need to reduce the rate at which slurry is dispensed.

A further object of the present invention has been that said improved slurry distribution lead to an improvement in the uniformity of material removal.

These objects have been achieved by providing a polishing system in which the substrate that is to be polished (generally a silicon wafer) is given three independent, simultaneously applied, modes of motion. These are: rotation of the platen, rotation of the wafer, and orbital motion of the wafer. A machine for realizing this is described which includes a crank that is used to cause the wafer to revolve in a closed path on the surface of the polishing pad at the same time that it moves around the circumference of the pad. A method for using this machine to perform CMP is described.

BRIEF DESCRIPTION OF THE DRAWINGS

FIGS. 1 and 2 are plan views of chem.-mech. polishers of the prior art.

FIG. 4 is a plan view of which FIG.3 is a cross-section.

DESCRIPTION OF THE PREFERRED EMBODIMENTS

Our primary application of the present invention has been an a means for planarizing the surface of an integrated circuit. As integrated circuits get built up, layer by layer, the surface becomes increasingly less planar. Eventually, this lack of planarity makes photolithography ineffective since sharp images can no longer be projected onto the surface for the purpose of creating in situ masks. At this point a planarizing step becomes mandatory. A low melting point material is deposited on the surface of the integrated circuit and heated till it flows, thereby finding its own level, filling in the voids and producing a level surface. Alternatively, the material may initially be liquid at room temperature and be converted to a solid by heating. Either way, after being returned to room temperature the solid material must now be etched back, either completely or to whatever thickness the manufacturing process requires at this stage. One method for achieving this etch back is CMP.

Regardless of the end purpose for which CMP is intended it is clearly important to remove material as uniformly as possible across the surface of the wafer that is being subjected to CMP. The limitations of the prior art in this regard have already been discussed. A key feature of the present invention is that the polishing system is given three, simultaneously applied, motions. These are: rotation of the platen, rotation of the wafer, and orbital motion of the wafer.

Figure 3:
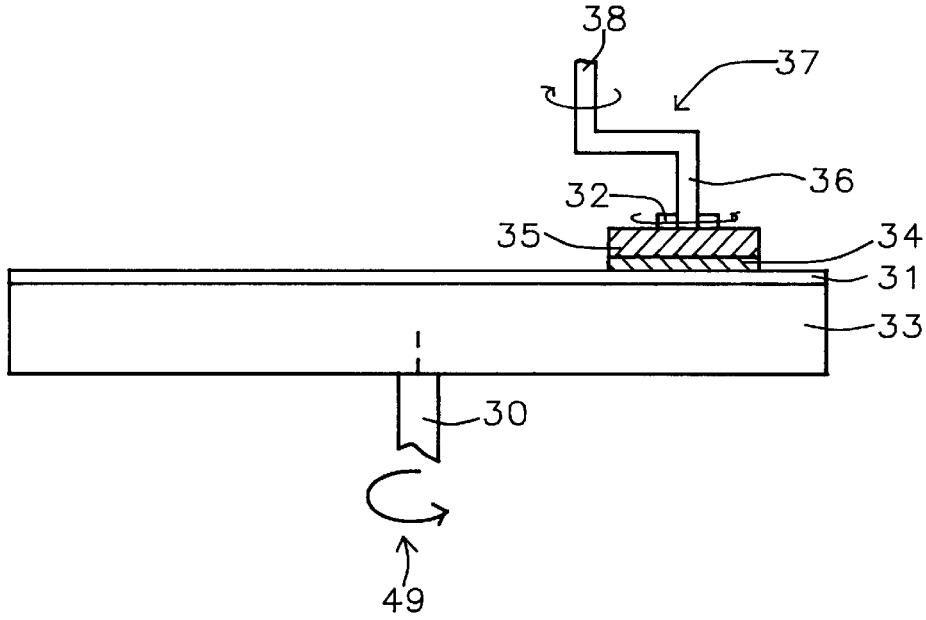
FIG. 3 is a cross-sectional view of a chem.-mech. polisher based on the present invention.

Referring now to FIG. 3, pad 31 is attached to and lies on platen 33 which can be rotated by means (not shown) attached to shaft 30, providing the platen and pad with motion symbolised by arrow 49. The platen is typically circular in shape and its diameter lies in the range of from about 6 to 12 inches.

Permanently mounted above the platen is crank 37 which includes vertical shaft 38 and parallel handle 36. Wafer holder 35 (holding wafer 34) is attached to the end of handle 36 so that wafer 34 will always be pressed up against pad 31. The attachment of the wafer holder to the handle may be such that the wafer holder is free to rotate in response to the motions of the handle and the platen or independent rotational means 32 may be provided so as to cause its rotation to be fully independent.

The wafer holder could be a vacuum chuck or the wafers could be attached to it by an adhesive material or some other method for holding the wafer could be used. Wafer diameters that may be effectively used to benefit from the present invention vary from about 3 inches to about 6 inches.

Thus, depending on the rate at which handle 36 revolves around shaft 38, wafer 31 will make many revolutions each time it completes a full circuit of the platen. Typically, the platen would complete up to about 100 revolutions per minute and the handle (and thus the wafer) would complete up to about 10 revolutions per minute about the shaft. When caused to independently rotate, the wafer could complete up to about 30 rotations for each revolution about the shaft.

Once the system is in motion, so that platen and wafer are rotating and the wafer is also revolving about shaft 38, slurry is supplied by standard means similar to tube 4 in FIG. 1. Similarly, used slurry is removed at an appropriately located drain site.

Figure 4:
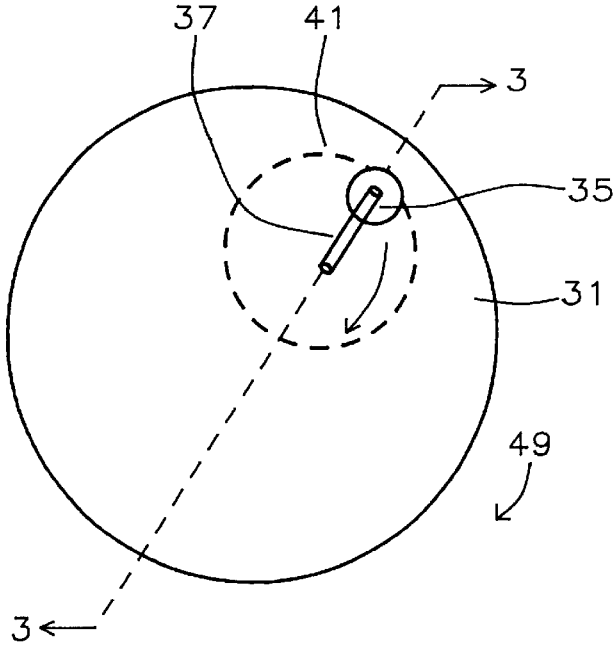

A plan view of the invention, of which FIG. 3 is a cross-section, is shown in FIG. 4. Broken line 41 marks the closed path along which wafer holder 35 moves as a result of its attachment to the handle of crank 37.

To apply the teachings of the present invention to CMP, the embodiment described above is provided, including the wafer to be polished which is kept pressed against the surface of the pad. Slurry is then dispensed onto and removed from the pad and the machine is set in motion, implying independent rotations of the platen and the wafer as well as orbital motion by the wafer. The invention will operate effectively with a wide range of slurry compositions.

While the invention has been particularly shown and described with reference to these preferred embodiments, it will be understood by those skilled in the art that various changes in form and details may be made without departing from the spirit and scope of the invention.

What is claimed is:

1. A method for chemical-mechanical polishing a silicon wafer, comprising:

providing a pad attached to a platen having a center of rotation;

dispensing slurry onto and removing slurry from said pad;

rotating the platen at between 10 and about 100 revolutions per minute;

while the platen is rotating, independently rotating the wafer at between 10 and about 30 revolutions per minute while holding it pressed against said pad; and while the platen and the wafer are rotating, causing the wafer to move over the pad along a closed path, that does not overlap said center of rotation, between 1 and about 10 times per minute.

2. The method of claim 1 wherein the diameter of said wafer is between about 3 and 6 inches.

* * * * *